US006119563A

United States Patent [19]

Fleck

[11] Patent Number: 6,119,563

[45] Date of Patent: Sep. 19, 2000

[54] INLINE BALL VALVE SHUTOFF TOOL

[76] Inventor: Ronald L. Fleck, P.O. Box 25, 201 S. High St., Port Matilda, Pa. 16870

[21] Appl. No.: 09/094,190

[22] Filed: Jun. 9, 1998

[51] Int. Cl.[7] ..... B25B 13/00

[52] U.S. Cl. ..... 81/488; 81/124.3

[58] Field of Search ..... 81/488, 119, 121.1, 81/124.2, 124.3, 124.7

[56] References Cited

U.S. PATENT DOCUMENTS

| | | | |
|---|---|---|---|
| 1,361,888 | 12/1920 | Messenger . | |
| 2,858,710 | 11/1958 | Landwehr et al. . | |
| 2,943,837 | 7/1960 | Noble . | |
| 3,010,346 | 11/1961 | Kulp | 81/124.2 |
| 4,446,763 | 5/1984 | Blough et al. . | |
| 5,440,956 | 8/1995 | Johnstun . | |
| 5,456,278 | 10/1995 | Morris et al. . | |
| 5,671,644 | 9/1997 | Anderson | 81/119 |
| 5,699,701 | 12/1997 | Cotten, Jr. | 81/124.2 |

*Primary Examiner*—David A. Scherbel
*Assistant Examiner*—Joni B. Danganan
*Attorney, Agent, or Firm*—John J. Elnitski, Jr.

[57] ABSTRACT

The present invention is an inline ball valve shutoff tool for moving an inline ball valve handle used to open and close inline ball valves. The tool allows access to inline ball valves that are difficult to reach due to obstructions and height restrictions. The tool allows for access through the maze of conduits and other obstructions which block access to inline ball valves. There are approximately eighteen different sizes of pipe commonly used for supply lines and all require different sized inline ball valves and valves handles. Generally pipe lines run in either a horizontal or vertical direction. For pipes running in the vertical direction, the inline ball valve handles operate in a vertical plane. For pipes running in the horizontal direction, the inline ball valve handles can operate in either the vertical plane or a horizontal plane. The different components of the inline ball valve tool allows for movement of different sized valve handles that are in any of the positions described above.

20 Claims, 7 Drawing Sheets

INLINE BALL VALVE SHUTOFF TOOL

BACKGROUND

Inline ball valves are installed as part of pipe line systems in hospitals, commercial buildings and private residences. The pipe lines supply water, steam, air, liquid fuel, and gases. The inline ball valves control the flow within the pipe lines and allow for flow shutdown for repairs, emergencies or the addition of other lines. A majority of the inline ball valves installed in hospitals and commercial buildings are in locations which are difficult to reach by hand and ladders are often needed to reach the inline ball valves. The factors contributing to the difficulty of reaching the inline ball valve handles are the following: installations in high ceilings; crowding of different pipe lines in the same area; and installation of pipe lines along with utility supply lines, electrical conduits, hot pipes, and HVAC air ducts.

There are many tools on the market to open and close valves. None of the current tools on the market totally address the difficulties of inline ball valve operation encountered in the locations the access difficulties as described above. Most currently available tools do not fit properly on the ball valve handle. The current tools can only be used on valves within immediate reach of the workmen. The current tools are made to fit only one specific valve and not the inline ball valve. The current tools do not have a flexible capability to meet the needs of a workman in the situations described above. What is needed is a tool which can address the access problems associated with inline ball valves.

It is an object of the present invention to provide a tool to open and close an inline ball valve that is difficult to access and a tool which is adjustable for different inline ball valve locations and access situations.

SUMMARY OF THE INVENTION

The present invention is an inline ball valve shutoff tool for moving a valve handle of an inline ball valve in order to open and close the valve. The tool includes attachable components to allow the user to adjust the tool depending on the position of the valve handle on the inline ball valve. The components of the tool include a tee handle, grip handle, a main rod, extension rods, couplers, three horizontal valve keys and three vertical valve keys. The above-mentioned components allow the user to configure the tool in either a horizontal or vertical configuration. The horizontal configuration of the tool allows the user to open and close an inline ball valve which has a valve handle that operates in the horizontal plane. The vertical configuration of the tool allows the user to open and close an inline ball valve which has a valve handle that operates in the vertical plane. The three horizontal valve keys are used in the horizontal configuration of the tool and three vertical valve keys are used in the vertical configuration of the tool. The extension rods and couplers allow the user to adjust the length of the tool. The horizontal and vertical keys have oval slots to accept a range of different sized valve handles. About three keys with different sized ovals for both the vertical and horizontal keys are needed to accept the wide range of valve handles.

DETAILED DESCRIPTION

Figure 1:
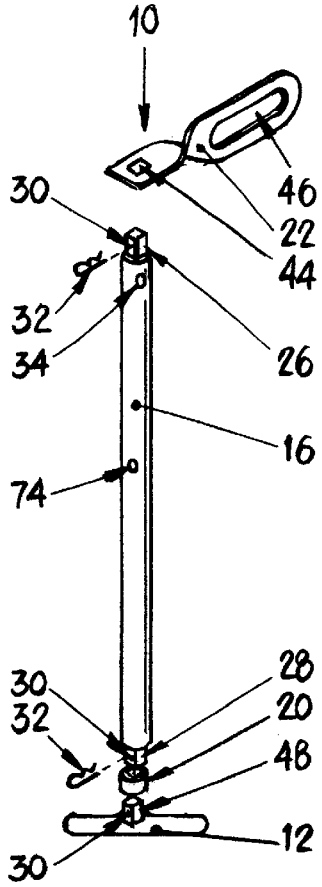
FIG. 1 is a perspective view of the inline ball valve shutoff tool in the horizontal configuration according to the present invention.

The present invention provides an inline ball valve shutoff tool for moving an inline ball valve hand le used to open and c lose inline ball valves. T he tool allows access to inline ball valves that are difficult to reach due to obstructions and height restrictions. The tool allows for access through the maze of co nduits and other obstructions which block access to inline ball valves. There are approximately eighteen different sizes of pipe commonly used for supply lines and all require different sized inline ball valves and valves handles. Generally pipe lines run in either a horizontal or vertical direction. For pipes running in the vertical direction, the inline ball valve handles operate in a vertical plane. For pipes running in the horizontal direction, the inline ball valve handles can operate in either the vertical plane or a horizontal plane. The inline ball valve handle is usually parallel with the pipe when the valve is open and perpendicular to the pipe when the valve is closed. The position of the inline ball valve handle thereby provides a visual reference as to whether the valve is open or close.

FIGS. 1–6 show the components of the inline ball valve shutoff tool 10 and FIGS. 7–17 show the operation of the tool 10. The components of the tool 10 include a tee handle 12, grip handle 14, a main rod 16, extension rods 18, couplers 20 (only one shown), three horizontal valve keys 22 (only one shown) and three vertical valve keys 24 (only one shown). The above-mentioned components allow the user to configure the tool 10 in either a horizontal or vertical configuration. The horizontal configuration of the tool 10 allows the user to open and close an inline ball valve 5 which has a valve handle 6 that operates in the horizontal plane. The vertical configuration of the tool 10 allows the user to open and close an inline ball valve 5 which has a valve handle 6 that operates in the vertical plane.

Figure 4A:
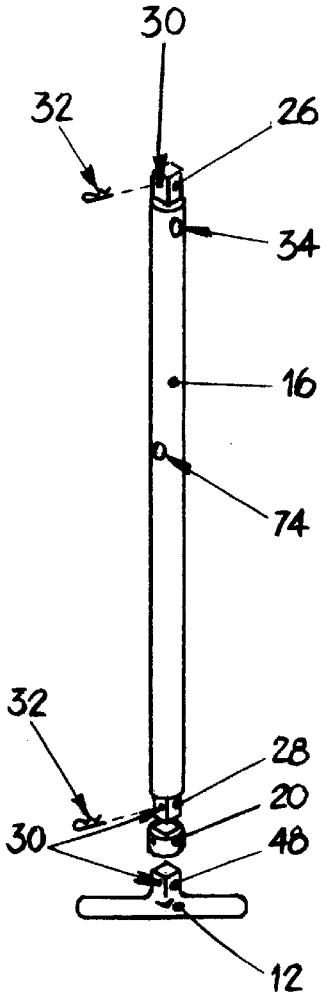
FIGS. 4A–4C are perspective views of three embodiments of a main rod of the inline ball valve shutoff tool according to the present invention.
Figure 4B:
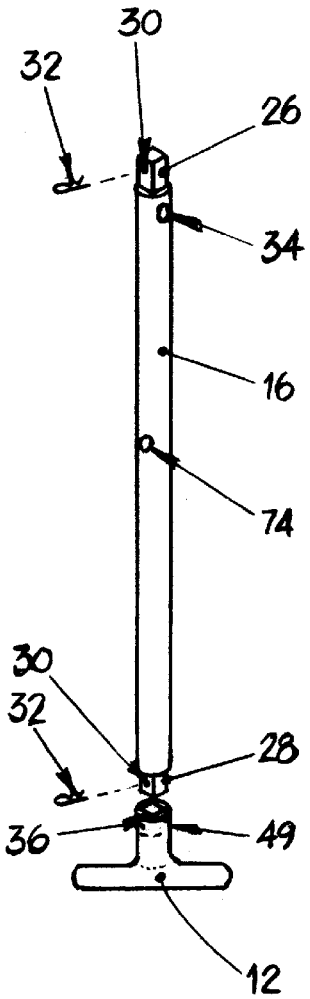
Figure 4C:
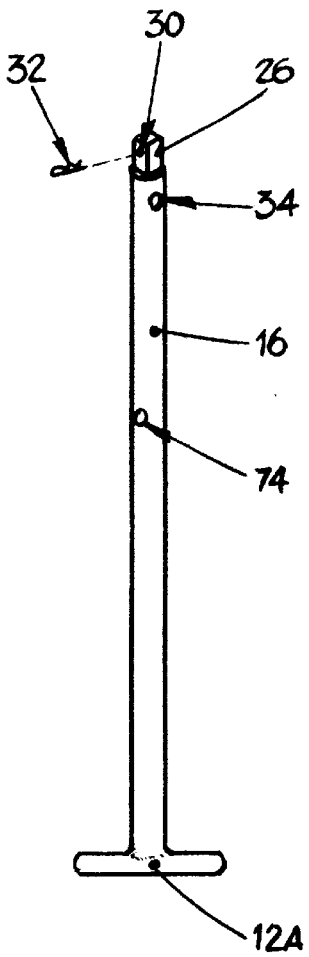

There are three embodiments of the main rod 16, as shown in FIGS. 4A–4C. The first and second main rod embodiment includes a first square end 26 and second square end 28, where each end 26, 28 has a through hole 30 to receive a removable pin 32. The rest of the components of the tool 10 are attached to the two square ends 26, 28 of the first main rod embodiment to form either the vertical or horizontal configuration of the tool 10. The third main rod embodiment include a first square end 26 and a permanent tee handle 12A as a second end, as shown in FIG. 4. The first square end 26 of either main rod embodiment engages either the horizontal key 22, vertical key 24 or the coupler 20. The second square end 28 of the first main rod embodiment engages either handle 12, 14 or the coupler 20. The extensions rods 18 are the same as the first main rod embodiment and can be of the same or different lengths. Having the main rod 16 and extension rods 18 of different lengths allows for the versatility of changing the total length of the tool 10. The main rod 12 of each embodiment and the extension rods 18 all include a bolt hole 34 near the first square end 26. Each coupler 20 is a cylinder having a square cavity 36 at each end 38 to receive a square end 26, 28 of either the main rod 16 or one of the extension rods 18. Each coupler 20 also includes two aligned holes 40 opposite each other in the walls 42 of each of the coupler's cavities 36 to receive a removable pin 32. As the removable pin 32 is inserted into the aligned holes 40, the pin 32 engages the hole 30 of either the rods 16, 18 or tee handle 12 or grip handle 14. Instead of the extension rods 18, a telescoping main rod (not shown) could be employed using any means known in the are of locking telescoping rods in an extended configuration.

Figure 5:
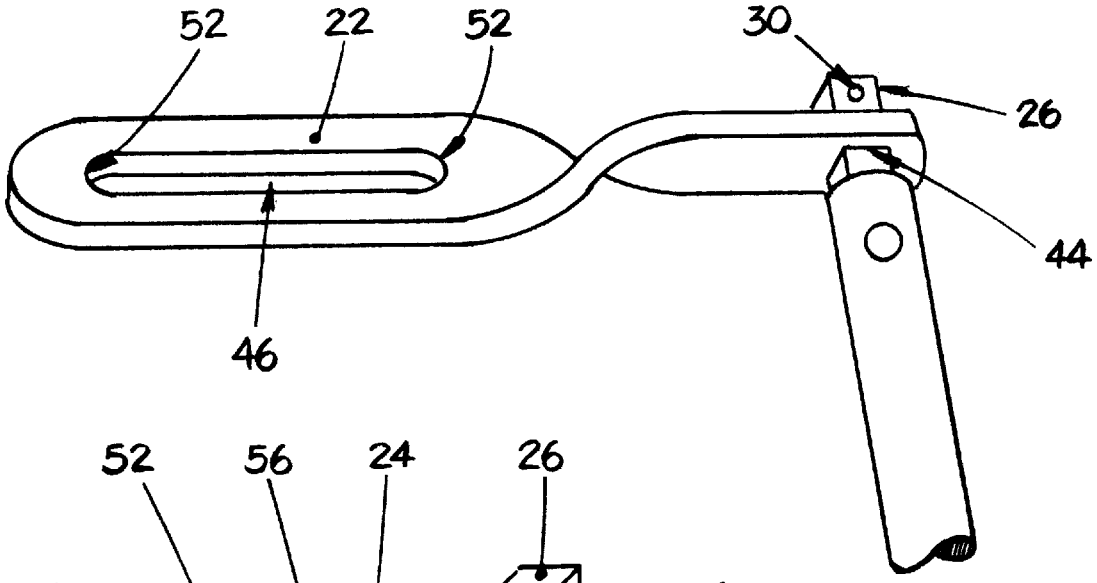
FIG. 5 is a perspective view of a horizontal valve key of the inline ball valve shutoff tool according to the present invention.
Figure 7:
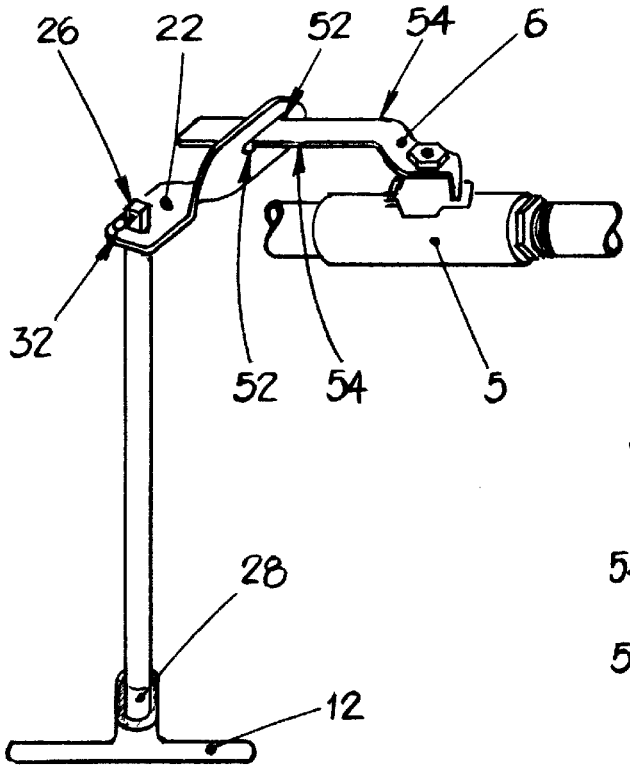
FIG. 7 is a perspective view of the horizontal configuration and an inline ball valve.

FIGS. 1, 5 and 7 show the tool 10 in the horizontal configuration. The horizontal valve keys 22 include a square slot 44 and an oval slot 46, which are perpendicular to each other. The square slot 44 receives the first square end 26 of the main rod 16. The first square end 26 slides into and engages the square slot 44 of the key 22, so that the hole 30 is above the key 22 as shown in FIG. 5. The removable pin 32 is inserted into the hole 30 to retain the key 22 on the main rod 16. The oval slot 46 is an oval shape to receive different sized valve handles 6. The oval slot 46 is oriented such that the slot 46 is perpendicular with an axial plane that would be perpendicular with the lengthwise direction of the main rod 16 and any extension rods 18. The purpose of providing three horizontal keys 22 is that three different size oval slots 46 are needed. The different sized oval slots 46 are needed because of the range of inline ball valve handle sizes. For instance, the size oval slot 46 required to operate one of the bigger valve handles 6 would be too big to operate one of the smaller valve handles 6 (not shown). If the first main rod embodiment is used, a tee handle 12 is mounted to the second square end 28 opposite to the first square end 26 that the key 22 is mounted, as shown in FIGS. 4A–4C. The tee handle 12 can have a square end 48 extending perpendicular to the handle 12 which is similar to the first square end 26 of the main rod 16 or have a socket end 49 extending from the handle 12 having a square cavity 36 similar to the couplers 20. The tee handle 12 with the square end 48 mounts to the main rod 16 by either inserting the square ends 28, 48 of the main rod 16 and the tee handle 12 into a coupler 20 and inserting the removable pins 32 into holes 30. The tee handle 12 with the socket end 49 mounts to the main rod 16 by inserting the second square end 28 of the main rod 16 into the cavity 36 of the socket end 49 of the tee handle 12. If the second main rod embodiment is used, there is no need to add the tee handle 12, as it is part of the main rod 16. Any needed extension rods 18 can be added by using the couplers 20 between the main rod 16 and an extension rod 18 or between extension rods 18. If an extension rod 18 is employed, the key 22 would be moved from the main rod 16 to the non-utilized first square end 26 of the last extension rod 18.

Figure 9:
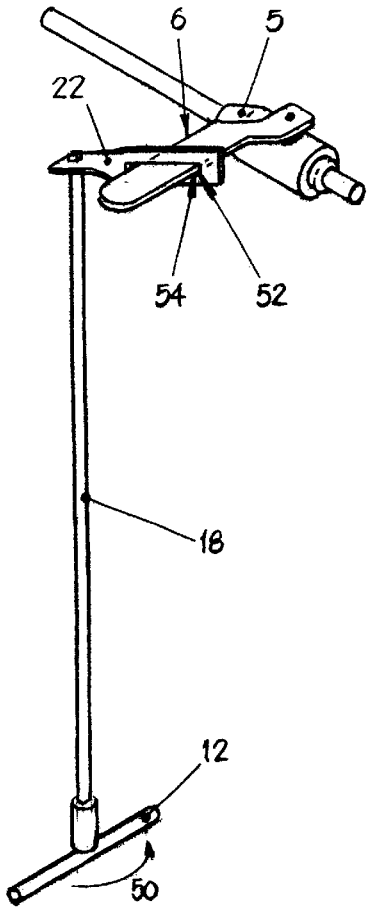
FIG. 9 is a perspective view of the horizontal configuration and an inline ball valve during the beginning of movement of a valve handle.
Figure 10:
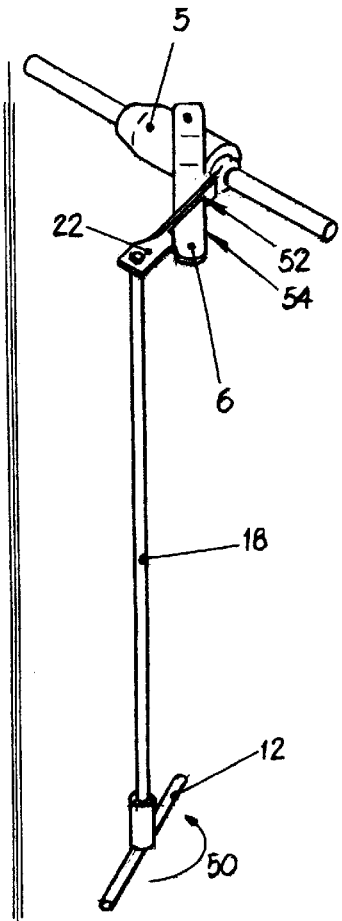
FIG. 10 is a perspective view of the horizontal configuration and an inline ball valve during movement of a valve handle.
Figure 11:
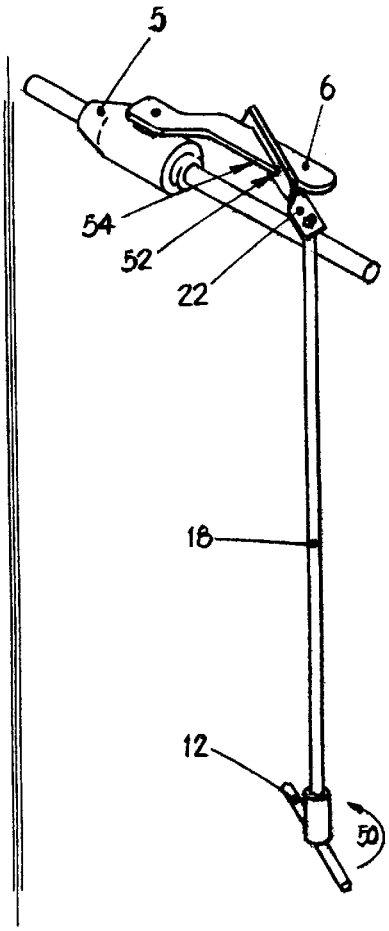
FIG. 11 is a perspective view of the horizontal configuration and an inline ball valve during the end of movement of a valve handle.

The movement of the valve handle 6 operating in the horizontal plane using the tool 10 assembled in the horizontal configuration is shown in FIGS. 7 and 9–11. The first step is to chose the horizontal key 22 with the correct sized oval slot 46 to fit the valve handle 6. The chosen horizontal key 22 is then secured to the first square end 26 of the main rod 16 or extension rod 18 as described above. If the first main rod embodiment is used, the tee handle 12 with the square end 48 or socket end is secured to the main rod 16 as described above. As described above, any necessary extension rods 18 and couplers 20 are added to provide the necessary length needed for the tool 10 to reach the valve handle 6. Once the tool 10 is assembled, the oval slot 46 of the key 22 is placed over the valve handle 6 as shown in FIG. 7. The movement of the valve handle 6 due to rotation of the tee handle 12 is shown in FIGS. 9–11. When the tee handle 12 is first rotated as indicated by arrow 50 in FIG. 9, sides 52 of the oval slot 46 contact the edges 54 of the valve handle 6. Continued rotation of the tee handle 12 in the direction of the arrow 50 will move the valve handle 6 from the closed position to the open position, as is shown by the sequence of FIGS. 9–11. To move the valve handle 6 from the open to closed position, simply repeat the steps as described above in this paragraph, but reverse the direction of rotation of the tee handle 12.

Figure 2:
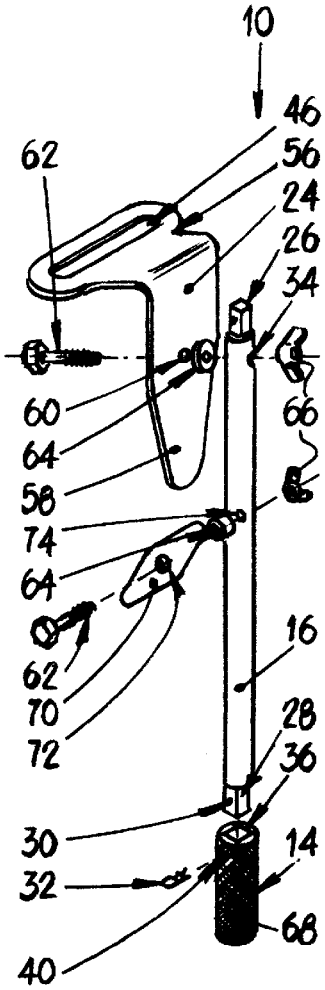
FIG. 2 is a perspective view of the inline ball valve shutoff tool in the vertical configuration according to the present invention.
Figure 3:
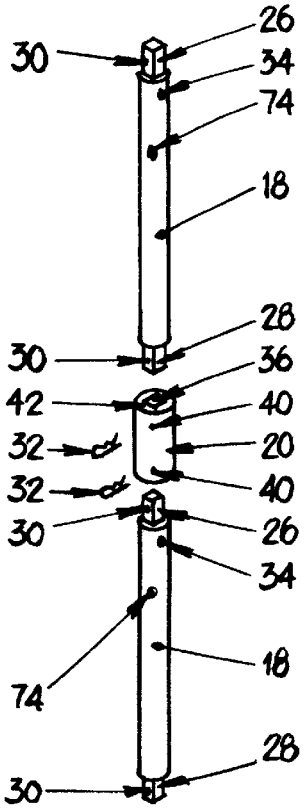
FIG. 3 is a perspective view of extension rods of the inline ball valve shutoff tool according to the present invention.
Figure 6:
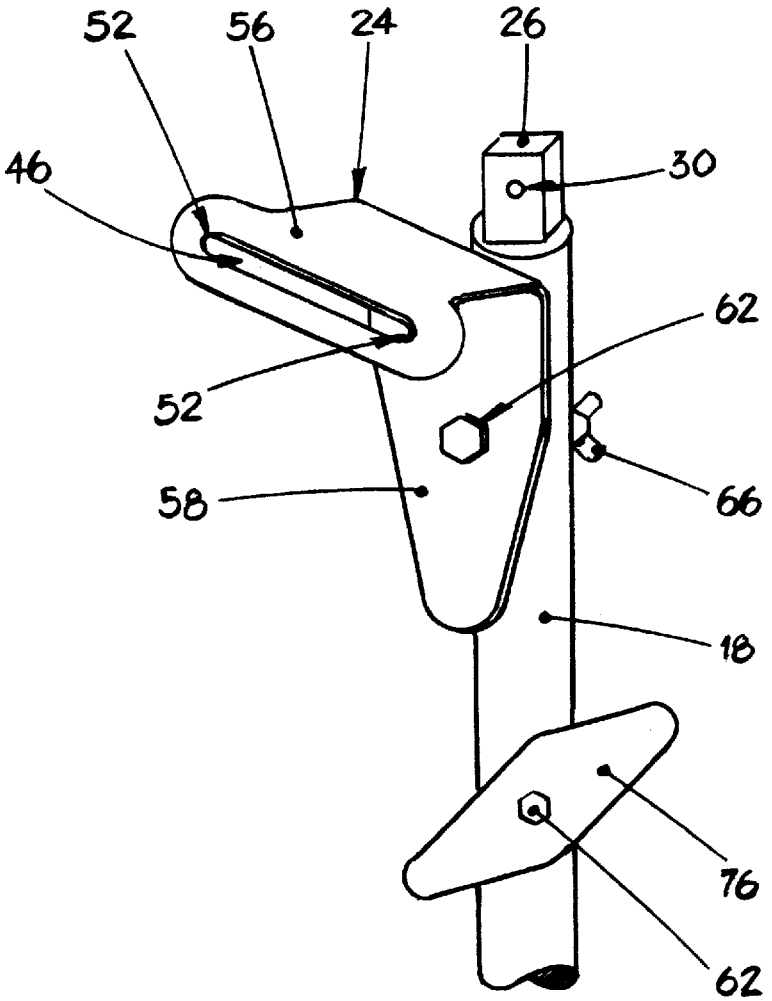
FIG. 6 is a perspective view of a vertical valve key of the inline ball valve shutoff tool according to the present invention.
Figure 8:
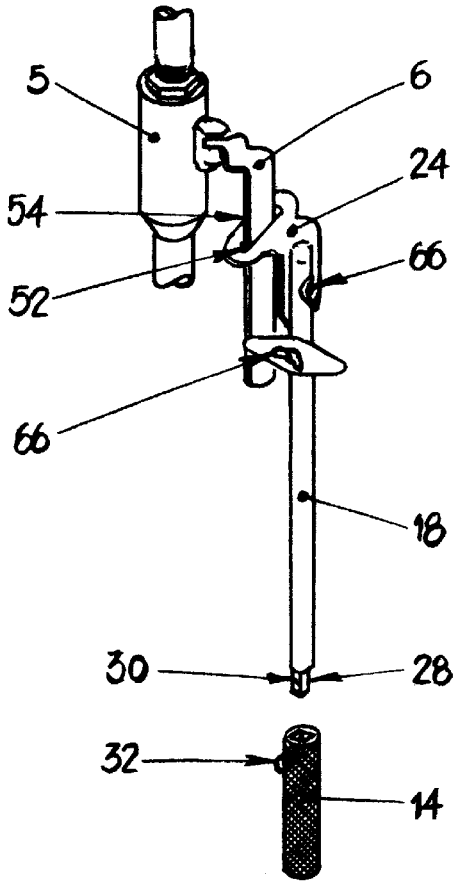
FIG. 8 is a perspective view of the vertical configuration and an inline ball valve.

FIGS. 2, 6 and 8 show the tool 10 in the vertical configuration. The vertical valve keys 24 (only one shown) include a head 56 and an arm 58 extending downward from the head 56. The arm 58 is perpendicular to the head 56 and includes a bolt hole 60. The head 56 includes an oval slot 46. The oval slot 46 is oriented such that the slot 46 is parallel with an axial plane that would be perpendicular with the lengthwise direction of the main rod 16 and any extension rods 18. The purpose of providing three vertical keys 24 is that three different size oval slots 46 are needed. The different sized oval slots 46 are needed because of the range of inline ball valve handle sizes. For instance, the size oval slot 46 required to operated one of the smaller valve handles 6 would be too small to operate one of the bigger valve handles 6 (not shown). A bolt 62, washer 64 and wingnut 66 are used to attach the vertical keys 24 to the main rod 16 using the bolt hole 34. The bolt 62 and wingnut 66 are not over-tightened when the key 24 is attached to the main rod 16, so that key 24 is rotatably fixed to the main rod 16. Either main rod embodiment may be used with the vertical configuration. If the first main rod embodiment is used, the grip handle 14 can be attached to the second square end 28. The grip handle 14 has a square cavity 36 with holes 40 in the same manner as described for the coupler 20 and includes an outside gripping surface 68. Also, an optional nudge plate 70 is included to aid the movement of larger handles 6, as shown in FIGS. 2, 8 and 12–17. The nudge plate 70 is a flat piece of metal and has a bolt hole 72. Bolt 62, washer 64 and wingnut 66 are used to attached the nudge plate 70 via the bolt hole 74 in the main rod 16 or extension rod 18.

Figures 12, 13, 14:
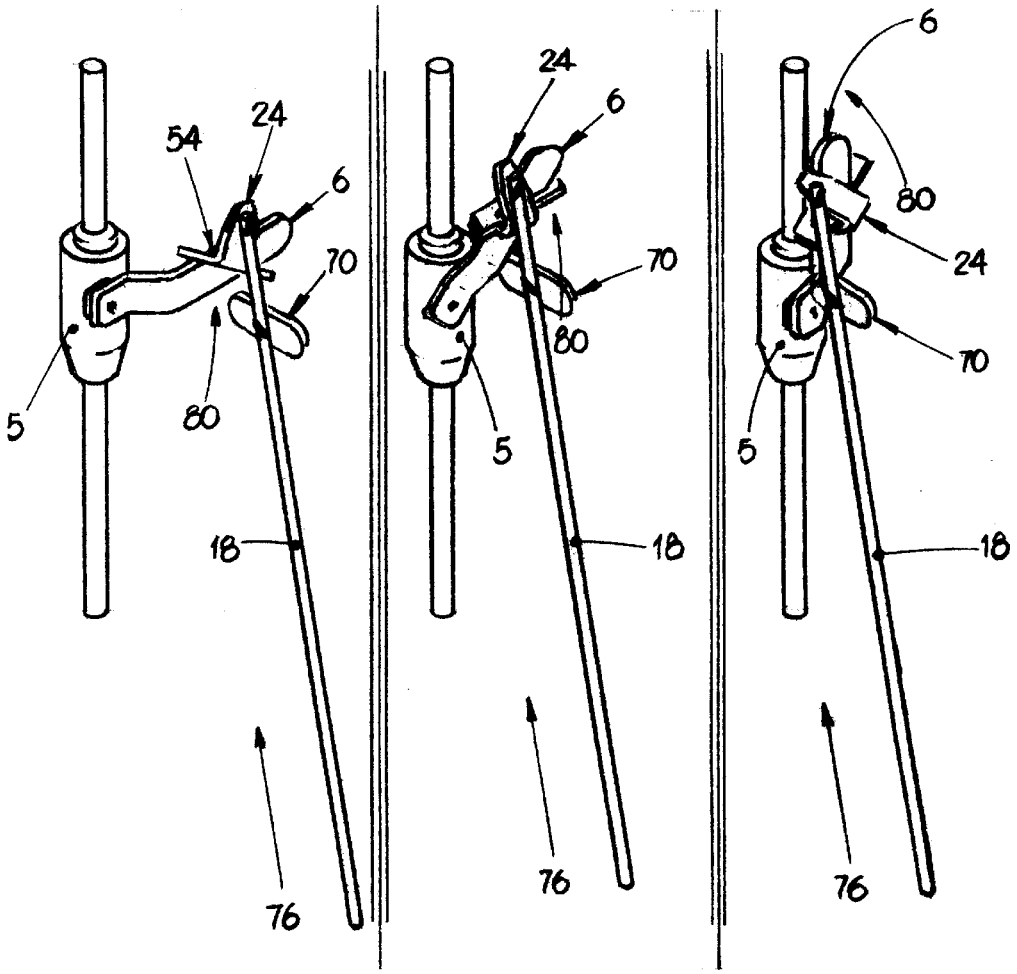
FIG. 12 is a perspective view of the vertical configuration and an inline ball valve during the beginning of movement of a valve handle for a valve in the vertical direction.
FIG. 13 is a perspective view of the vertical configuration and an inline ball valve during movement of a valve handle for a valve in the vertical direction.
FIG. 14 is a perspective view of the vertical configuration and an inline ball valve during the end of movement of a valve handle for a valve in the vertical direction.
Figure 15:
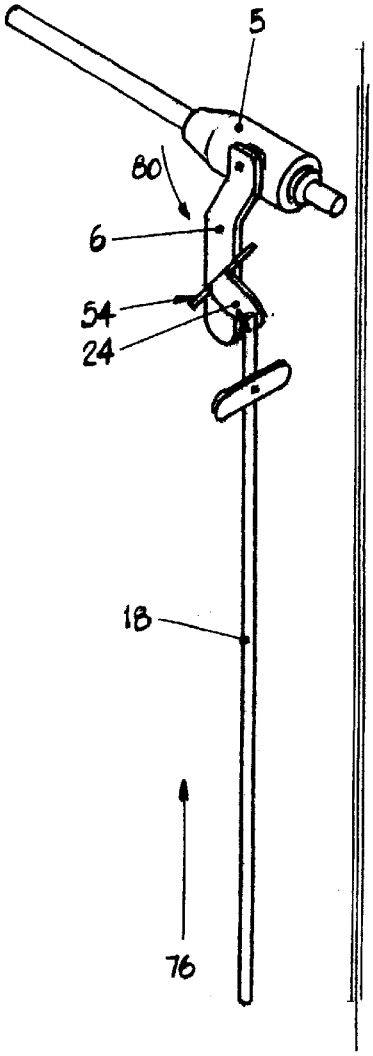
FIG. 15 is a perspective view of the vertical configuration and an inline ball valve during the beginning of movement of a valve handle for a valve in the horizontal direction.
Figure 16:
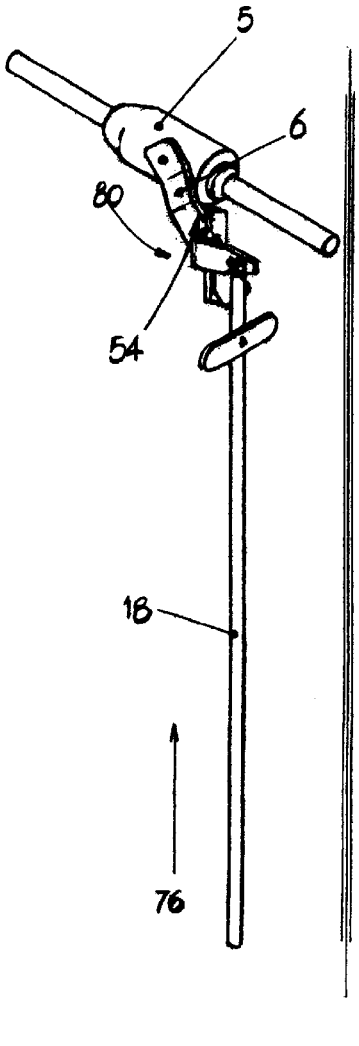
FIG. 16 is a perspective view of the vertical configuration and an inline ball valve during movement of a valve handle for a valve in the horizontal direction.
Figure 17:
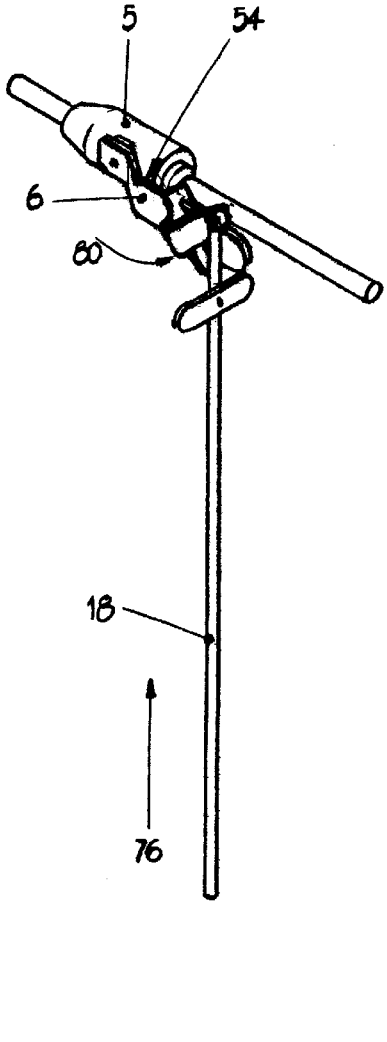
FIG. 17 is a perspective view of the vertical configuration and an inline ball valve during the end of movement of a valve handle for a valve in the horizontal direction.

The movement of a valve handle 6 operating in the vertical plane using the tool 10 in the vertical configuration is shown in FIGS. 8 and 12–17. The first step is to choose the vertical key 24 with the correct sized oval slot 46 to fit the valve handle 6. The chosen vertical key 24 is then secured to the first square end 26 of the main rod 16 as described above. The grip handle 14 can be added to the first main rod embodiment if desired, as described above. Also, it is possible to use the second main rod embodiment. As described above, any necessary extension rods 18 and couplers 20 are added to provide the necessary length needed for the tool 10 to reach the valve handle 6. Once the tool 10 is assembled, the oval slot 46 of the vertical key 24 is placed over the valve handle 6 as shown in FIG. 8. The movement of the valve handle 6 is shown in the sequence of FIGS. 12–14 and FIGS. 15–17. The two sets of FIGS. 12–14 and 15–17 are shown because the valve handle 6 can operate in the vertical plane when mounted on pipes that run in the vertical or horizontal direction. FIGS. 12–14 and 15–17 show the valve handle 6 movement from a closed position to an open position. To move the valve handle 6, the main rod 16 is pushed upward. As the main rod 16 is pushed upward as indicated by the arrow 76, sides 52 of the oval slot 46 contact the edges 54 of the valve handle 6 as shown in FIGS. 12 and 15. The upward movement of the main rod 16 and rotation of the valve key 24 locks the key 24 against the valve handle 6. As the key 24 is pushed upward by the main rod 16 , the valve handle 6 rotates in the direction shown by the arrow 76. Continued upward movement of the main rod 16 will move the valve handle 6 from the closed position to the open position, as shown by arrow 80 in the sequence of FIGS. 12–14 and 15–17. To move the valve handle 6 from the open to closed position, simply repeat the steps as described above in this paragraph, but pull down on the main rod 16. The optional nudge plate 70 is used for the larger size valve handles 6 which need more force to be moved than the smaller handles 6. The nudge plate 70 is positioned against the handle 6 as shown in FIG. 8. The nudge plate 70 provides a fixed surface against the valve handle 6 and provides leverage to start the movement for handles which require more force to move.

While embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of the appended claims and any and all equivalents thereof.

I claim:

1. A tool for engaging an inline ball valve handle, the tool comprising:

a main rod;

at least one detachable valve key attached to said main rod; and a slot in said valve key to receive the handle of an inline ball valve.

2. The tool of claim 1, wherein said main rod includes a square end, wherein said valve key includes an end with a square hole that fits over said square end and wherein said square end includes a hole to receive a pin which retains said valve key.

3. The tool of claim 1, wherein at least one valve key allows operation in a horizontal plane.

4. The tool of claim 3, wherein said slot is orientated in a plane parallel to a lengthwise direction of said main rod to allow operation of the tool in a horizontal plane.

5. The tool of claim 1, wherein at least one valve key allows operation in a vertical plane.

6. The tool of claim 5, wherein said slot is orientated in a plane perpendicular to a lengthwise direction of said main rod to allow operation of the tool in a vertical plane.

7. The tool of claim 1, further including at least one extension rod attachable to said main rod to extend the length of said tool.

8. The tool of claim 7, further including at least one coupler to interconnect said extension rod and said main rod.

9. The tool of claim 8, wherein said main rod and extension rod each have ends with coupler pin holes; wherein said coupler has at least two ends with coupler pin holes and further including coupler pins, whereby said coupler pin holes of the main rod and extension rod can be aligned with said coupler pin holes of said coupler and said coupler pins are inserted in the aligned pin holes to retain the coupler to the main rod and extension rod.

10. The tool of claim 1, further including a tee handle attached to said main rod.

11. The tool of claim 10, wherein said tee handle is detachable from said main rod.

12. The tool of claim 1, further including a nudge plate attached to the main rod below said valve key to aid movement of said handle.

13. The tool of claim 1, wherein said slot is an oval shape.

14. A tool for engaging an inline ball valve handle, the tool comprising:

a main rod means for mounting of components of said tool; and detachable valve key means for moving the inline ball valve handle wherein the detachable valve key means is attached to said main rod means.

15. The tool of claim 14, wherein said detachable valve key means includes a horizontal means for moving said inline ball valve handle in a horizontal plane.

16. The tool of claim 14, wherein said detachable valve key means includes a vertical means for moving said inline ball valve handle in a vertical plane.

17. The tool of claim 14, further including an extension rod means for extending the length of said tool attachable to said main rod means.

18. The tool of claim 17, further including a coupler means for connecting said main rod means and said extension rod means.

19. The tool of claim 14, further including a nudge plate means for aiding movement of said handle attachable to said main rod.

20. The tool of claim 14, further including a tee handle means for turning said tool attachable to said main rod.

* * * * *